US008567336B1

(12) United States Patent
Mazin

(10) Patent No.: US 8,567,336 B1
(45) Date of Patent: Oct. 29, 2013

(54) DIVER PROPULSION ASSEMBLY AND METHOD

(75) Inventor: Benjamin A. Mazin, Goleta, CA (US)

(73) Assignee: Jetboots Holdings, LLC, Fredericksburg, VA (US)

( * ) Notice: Subject to any disclaimer, the term of this patent is extended or adjusted under 35 U.S.C. 154(b) by 143 days.

(21) Appl. No.: 12/927,704

(22) Filed: Nov. 22, 2010

(51) Int. Cl.
*B63C 11/46* (2006.01)

(52) U.S. Cl.
USPC ..... 114/315

(58) Field of Classification Search
USPC ..... 114/315
See application file for complete search history.

(56) References Cited

U.S. PATENT DOCUMENTS

| | | | | |
|---|---|---|---|---|
| 2,543,313 | A * | 2/1951 | Dietzgen | 224/240 |
| 5,868,652 | A * | 2/1999 | Spletzer | 482/105 |
| 6,041,444 | A * | 3/2000 | McKinney | 2/310 |
| 6,823,813 | B2 * | 11/2004 | Mazin | 114/315 |
| 7,165,706 | B2 * | 1/2007 | Barr | 224/661 |

* cited by examiner

*Primary Examiner* — Stephen Avila
(74) *Attorney, Agent, or Firm* — Schwartz Law Firm, P.C.

(57) ABSTRACT

A diver propulsion assembly includes a waist belt and at least one thruster. A thruster mounting assembly cooperates with the waist belt to mount the thruster to an upper leg of the diver.

19 Claims, 5 Drawing Sheets

DIVER PROPULSION ASSEMBLY AND METHOD

TECHNICAL FIELD AND BACKGROUND

The present disclosure relates broadly to a diver propulsion assembly and method. Exemplary embodiments described herein have application to any movement of a user (or "diver") through a body of water, including underwater SCUBA diving, free diving, snorkeling, swimming, and the like. Embodiments of the present disclosure may be used for recreational purposes or in combination with military issue combat swimming gear. Examples of military uses include reconnaissance, search and rescue, patrols, hull inspections, and the like.

SUMMARY OF EXEMPLARY EMBODIMENTS

Various exemplary embodiments of the present invention are described below. Use of the term "exemplary" means illustrative or by way of example only, and any reference herein to "the invention" is not intended to restrict or limit the invention to exact features or steps of any one or more of the exemplary embodiments disclosed in the present specification. References to "exemplary embodiment," "one embodiment," "an embodiment," "various embodiments," and the like, may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

It is also noted that terms like "preferably", "commonly", and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention.

According to one exemplary embodiment, the present disclosure comprises a diver propulsion assembly including a waist belt and at least one thruster. Means cooperates with the waist belt to mount the thruster to an upper leg of the diver.

The term "diver" refers broadly herein to an individual who moves through a body of water, either partially or entirely submerged therein.

The term "upper leg" is defined herein as that portion of the body extending generally between the knee and waist.

The term "waist belt" refers broadly to any belt, harness, or other torso-encircling or substantially encircling structure worn on or around the waist, and capable of carrying one or more thrusters.

According to another exemplary embodiment, the means comprises a thruster mounting assembly including an elongated thigh-carried thruster retention frame joined (directly or indirectly) at its proximal end to the waist belt.

According to another exemplary embodiment, the thruster mounting assembly is hinged to the waist belt at an ergonomic hinge point for enabling ergonomic movement of the thruster relative to the waist belt during operation of the propulsion assembly by the diver.

According to another exemplary embodiment, the waist belt incorporates a short hinge strap attached to the thruster mounting assembly, and enabling ergonomic movement of the thruster relative to the waist belt during operation of the propulsion assembly by the diver.

According to another exemplary embodiment, the thruster mounting assembly further includes an ergonomic pivot joint intermediate the thruster retention frame and the hinge strap.

According to another exemplary embodiment, the pivot joint includes first and second cooperating connectors pivotably attached together. The connectors enable ergonomic pivoting of the thruster about a pivot axis generally perpendicular to a pivot axis of the hinge strap.

According to another exemplary embodiment, the thruster mounting assembly further includes an adjustable leg strap attached to a distal end of the thruster retention frame, and cooperating with the waist belt to secure the thruster to the upper leg of the diver.

According to another exemplary embodiment, the thruster mounting assembly extends outwardly from the waist belt approximately 12-18 inches.

According to another exemplary embodiment, the thruster incorporates an electric motor and propeller.

According to another exemplary embodiment, a diver-actuated motor controller is adapted for selectively adjusting a drive speed of the propeller.

According to another exemplary embodiment, a battery pack is operatively connected to the electric motor.

In another exemplary embodiment, the disclosure comprises a diver propulsion assembly including a waist belt adapted for wear by a diver, first and second spaced apart thrusters for propelling the diver through a body of water, and first and second thruster mounting assemblies cooperating with the waist belt for mounting respective first and second thrusters to upper legs of the diver.

According to another exemplary embodiment, the first and second thrusters are carried by the waist belt (at least partially), and spaced apart approximately 18-24 inches along an extended length of the waist belt.

In yet another exemplary embodiment, the disclosure comprises a method for propelling a diver through a body of water. The method includes mounting first and second thrusters to respective thighs of the diver, each thruster comprising a drive motor and propeller. Output of the drive motor is controlled by the diver to selectively adjust a drive speed of the propeller.

BRIEF DESCRIPTION OF THE DRAWINGS

The description of exemplary embodiments proceeds in conjunction with the following drawings, in which.

DESCRIPTION OF EXEMPLARY EMBODIMENTS AND BEST MODE

The present invention is described more fully hereinafter with reference to the accompanying drawings, in which one or more exemplary embodiments of the invention are shown. Like numbers used herein refer to like elements throughout. This invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limiting as to the scope of the invention, which is to be given the full breadth of the appended claims and any and all equivalents thereof. Moreover, many embodiments, such as adaptations, variations, modifications, and equivalent arrangements, will be implicitly disclosed by the embodiments described herein and fall within the scope of the present invention.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at least one of the items, but does not exclude a plurality of items of the list.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has been previously reduced to practice or that any testing has been performed. Likewise, unless stated otherwise, use of verbs in the past tense (present perfect or preterit) is not intended to indicate or imply that the invention has been previously reduced to practice or that any testing has been performed.

Figure 1:
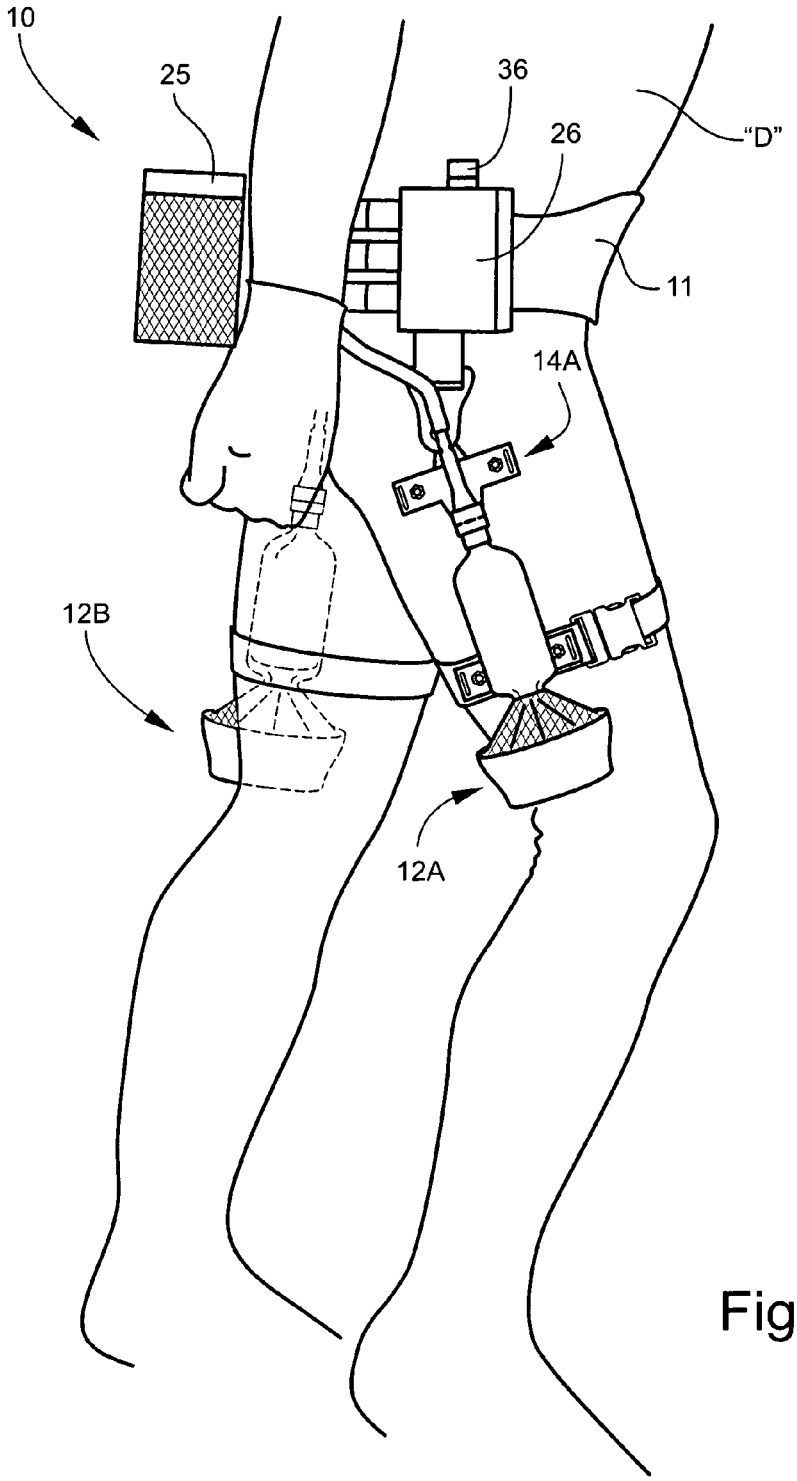
FIG. 1 is an environmental view of a thigh-mounted hands-free diver propulsion assembly according to one exemplary embodiment of the present disclosure.
Figure 2:
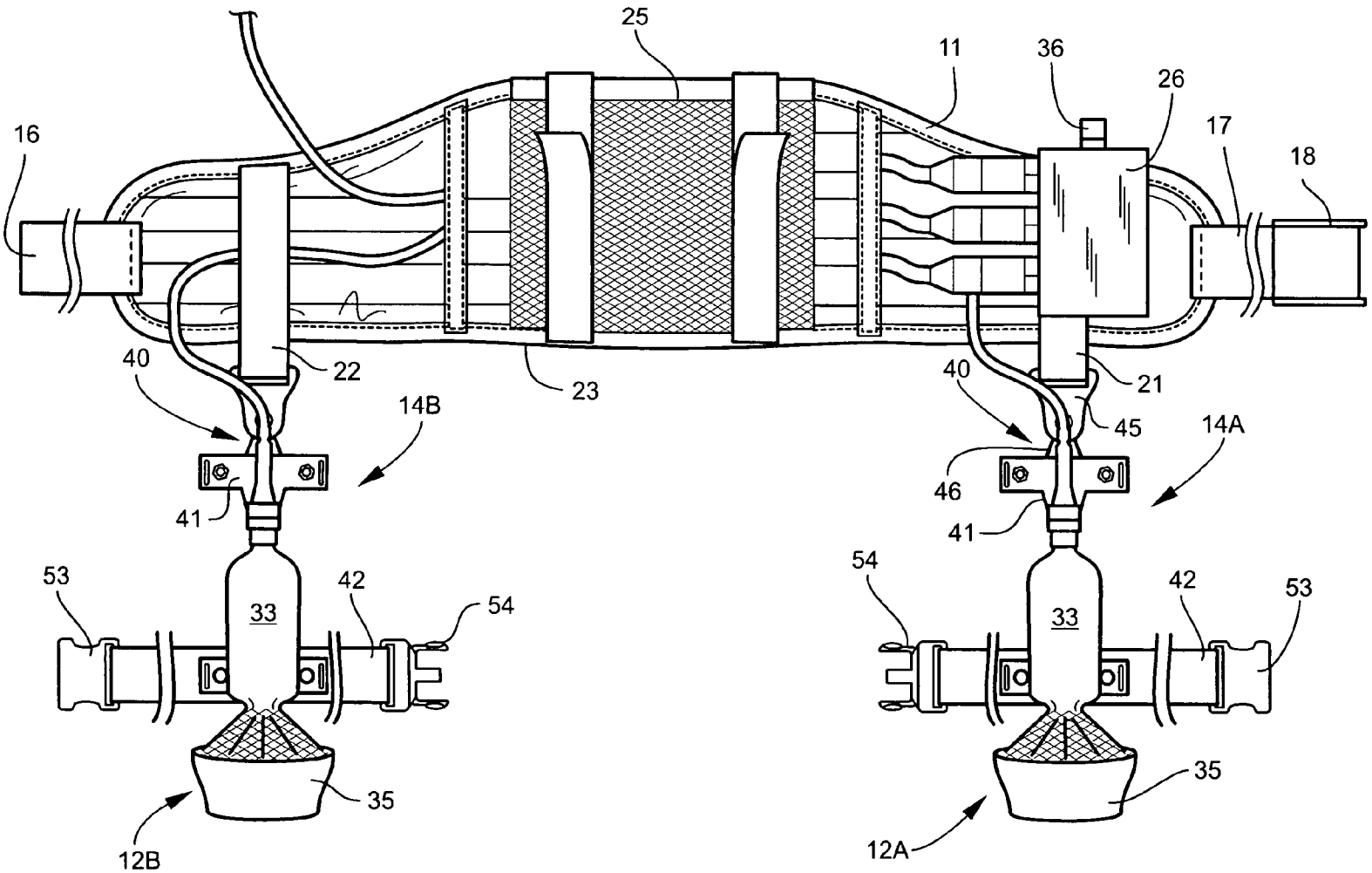
FIG. 2 is an outside elevational view of the exemplary diver propulsion assembly.

Referring now specifically to the drawings, a hands-free diver propulsion assembly according to one exemplary embodiment of the present invention is illustrated in FIGS. 1 and 2, and shown generally at reference numeral 10. The exemplary assembly 10 includes a flexible waist belt 11 worn by the diver "D", first and second spaced apart thigh-mounted thrusters 12A, 12B for propelling the diver "D" through water, and first and second thruster mounting assemblies 14A, 14B (See FIG. 2). The thruster mounting assemblies 14A, 14B cooperate with the waist belt 11 to mount and secure respective thrusters 12A, 12B to upper legs of the diver "D", as shown in FIG. 1.

As best shown in FIG. 2, the exemplary waist belt 11 has opposing elongated nylon ends 16 and 17, and a levered quick connect/disconnect buckle 18. The belt buckle 18 may allow ready and convenient length adjustment to custom fit the waist belt 11 to the diver. The waist belt 11 further comprises intermediate nylon hinge straps 21 and 22 extending slightly from a longitudinal edge 23 of the belt 11, and designed to carry respective thrusters 12A, 12B and thruster mounting assemblies 14A, 14B (described further below). The thruster mounting assemblies 14A, 14B are spaced apart approximately 18-24 inches along a length of the waist belt 11, and locate at their respective far ends approximately 12-18 inches from the longitudinal belt edge 23. By this arrangement, the thrusters 12A, 12B mount substantially adjacent respective outer thighs of the diver when the propulsion assembly 10 is properly positioned and secured. The exemplary thrusters 12A, 12B are electrically connected to a battery pack 25 and motor controller 26, and operate in a conventional manner to propel the diver through water as described in prior U.S. Pat. No. 6,823,813 to Mazin—the complete disclosure of this prior patent being incorporated by reference herein. The battery pack 25 and controller 26 may be releasably attached to the waist belt 11 by cooperating straps, mating fasteners, clips, pockets, or other suitable means. Alternatively, these components may be attached at any other location on the body of the diver, or on other equipment or devices carried by the diver.

Figure 3:
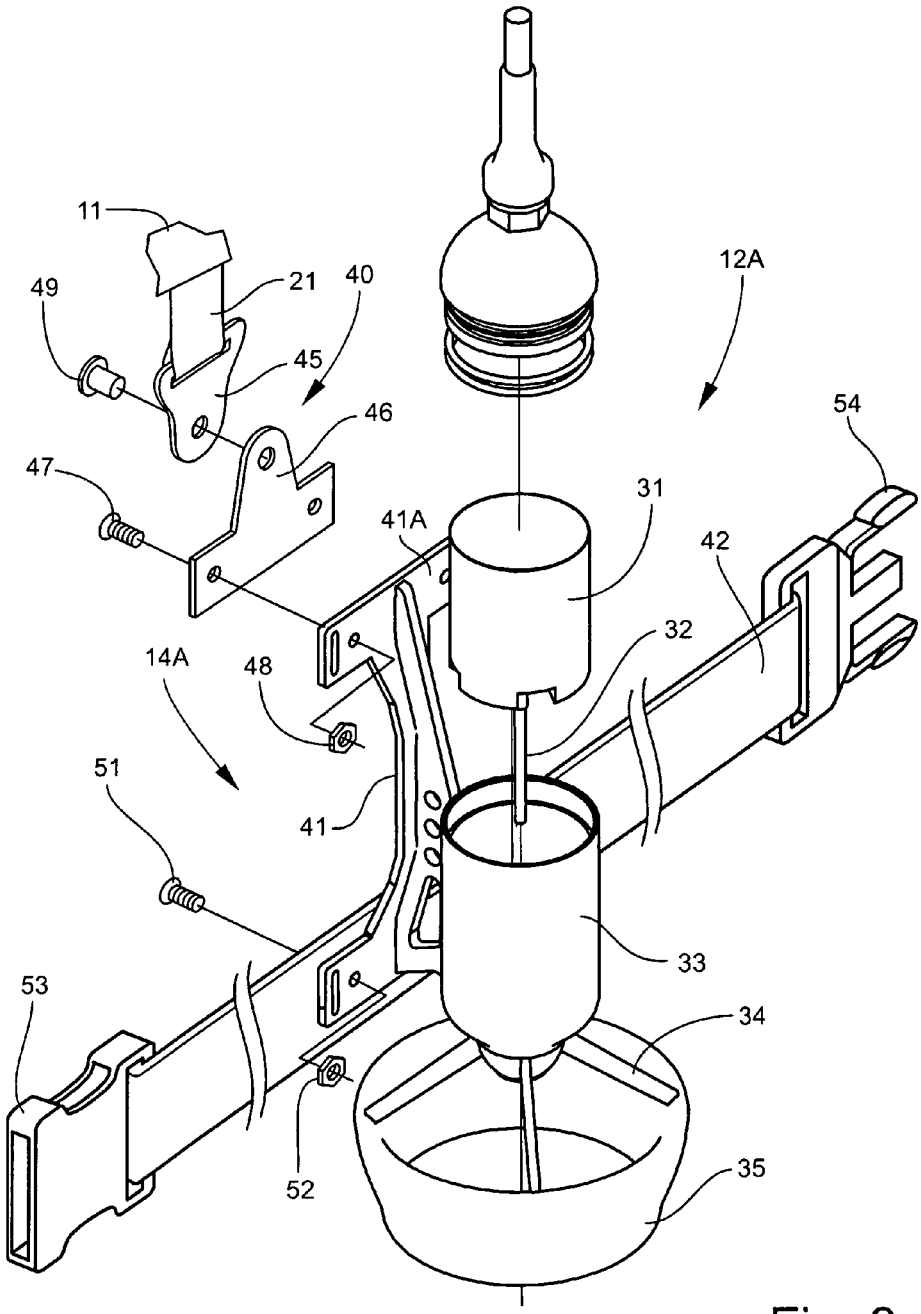
FIG. 3 is an exploded view of the thruster and thruster mounting assembly.
Figure 4:
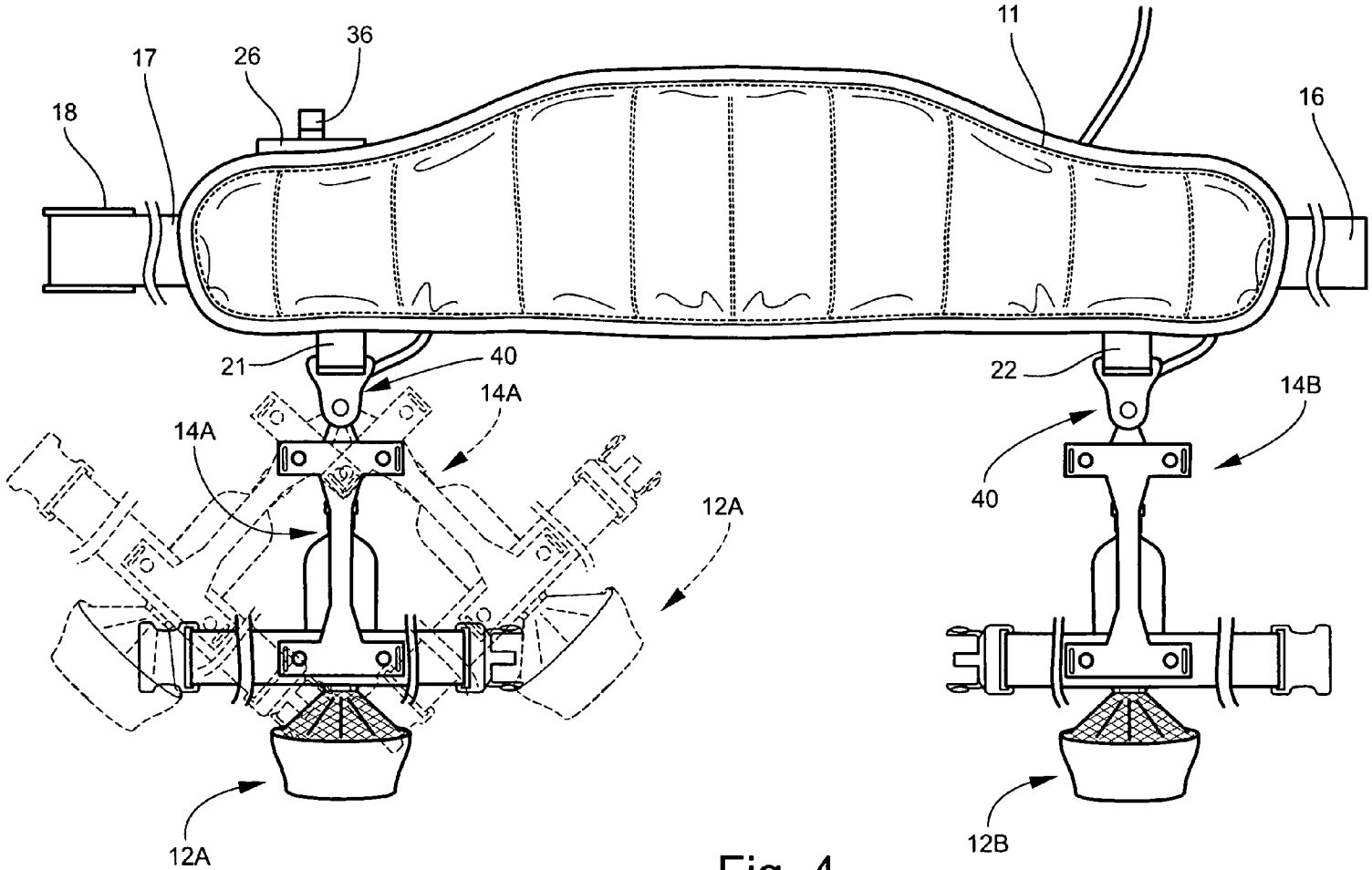
FIG. 4 is an inside elevational view of the diver propulsion assembly, and demonstrating ergonomic pivoting movement of the thruster and thruster mounting assembly relative to the waist belt.

As shown in FIG. 3, each thruster 12A, 12B (only 12A shown) comprises an electric motor 31 and drive shaft 32 substantially contained within a sealed cylindrical housing 33, and operatively connected (e.g., via speed-reducing gearbox) to a standard high-speed propeller 34. The electric motor 31 may comprise a brushless DC motor. The exemplary propeller 34 may turn at variable speeds of up to 4500 rpm or more, and is surrounded by a protective ring 35 and mesh covering. The thruster speed and its ON/OFF states may be controlled by the diver via a rotatable actuator knob 36 (See FIGS. 1, 2, and 4) on the motor controller 26. The actuator knob 36 is operatively connected to a potentiometer located inside the controller housing, and can include the ON/OFF switch function at one end of its range of operation.

Figure 5:
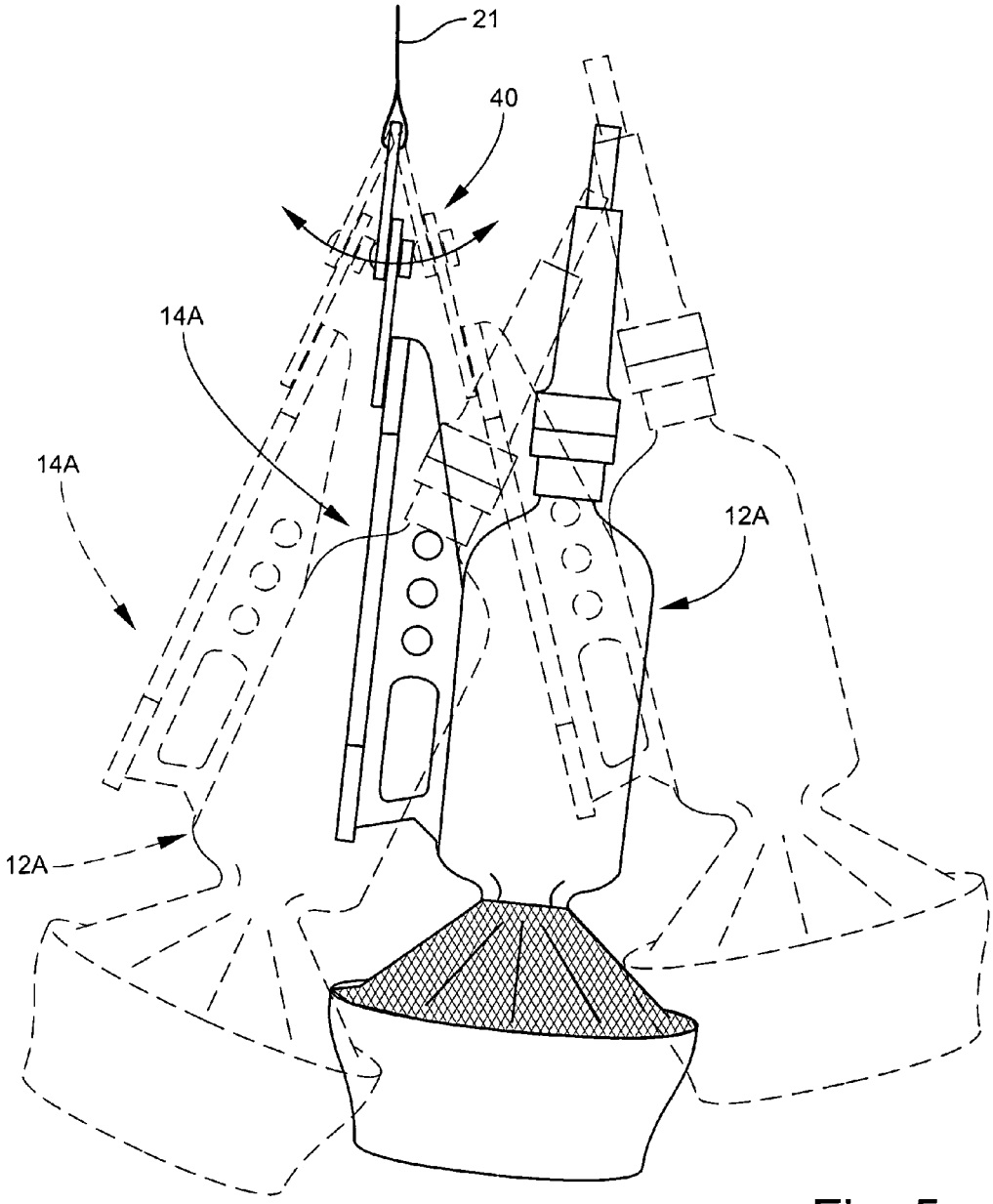
FIG. 5 is a side view of a single thruster and thruster mounting assembly, demonstrating their ergonomic pivoting movement about an axis generally perpendicular to the pivot axis shown in FIG. 4.

Components of a single thruster 12A and thruster mounting assembly 14A are detailed in FIG. 3. Thruster 12B and thruster mounting assembly 14B incorporate components identical to those shown in FIG. 3, and mount to the diver and function in an identical manner. Referring to FIG. 3, the thruster mounting assembly 14A is joined to the waist belt 11 by flexible hinge strap 21, as previously described, and includes a pivot joint 40, a generally I-shaped rigid (e.g., metal) thruster retention frame 41, and an adjustable nylon leg strap 42. The pivot joint 40 comprises a first metal connector 45 attached to the hinge strap 21, and a cooperating second metal connector 46 attached to an upper end 41A of the thruster retention frame 41. The connector 46 and retention frame 41 are releasably attached together by hardware, such as complementary bolts and nuts 47, 48, while the thruster 12A may be permanently (e.g., integrally) or releasably affixed to the retention frame 41. For example, the thruster 12A may be permanently welded at housing 33 to a raised center portion of the retention frame 41. The first and second connectors 45, 46 are pivotably attached together by metal rivet 49, and cooperate as demonstrated in FIG. 4 to enable a wide range of ergonomic pivoting movement of the thruster 12A and thruster mounting assembly 14A relative to the waist belt 11. Additionally, as demonstrated in FIG. 5, the hinge strap 21 may enable simultaneous ergonomic pivoting of the thruster 12A and thruster mounting assembly 14A about an axis generally perpendicular to the axis of the ergonomic pivot joint 40. The flexible nylon leg strap 42 of each assembly 14A, 14B is attached to a lower end 41B of the thruster retention frame 41 using complementary bolts and nuts 51, 52, and has mating quick connect/disconnect buckle fasteners 53, 54 at respective opposite ends.

When properly worn and used by the diver, the exemplary propulsion assembly 10 may offer increased mobility and maneuverability, and enable more natural ergonomic movement of the diver's legs both in and out of the water. The thruster mounts and connections may be hinged and/or pivoted, as described above, or rigid and fixed.

For the purposes of describing and defining the present invention it is noted that the use of relative terms, such as "substantially", "generally", "approximately", and the like, are utilized herein to represent an inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

Exemplary embodiments of the present invention are described above. No element, act, or instruction used in this description should be construed as important, necessary, critical, or essential to the invention unless explicitly described as such. Although only a few of the exemplary embodiments have been described in detail herein, those skilled in the art will readily appreciate that many modifications are possible in these exemplary embodiments without materially departing from the novel teachings and advantages of this invention. Accordingly, all such modifications are intended to be included within the scope of this invention as defined in the appended claims.

In the claims, any means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Unless the exact language "means for" (performing a particular function or step) is recited in the claims, a construction under §112, 6th paragraph is not intended. Additionally, it is not intended that the scope of patent protection afforded the present invention be defined by reading into any claim a limitation found herein that does not explicitly appear in the claim itself.

What is claimed:

1. A diver propulsion assembly, comprising:

a waist belt adapted for wear by a diver;

a thigh-mounted thruster for propelling the diver through a body of water; and means cooperating with said waist belt for mounting said thruster directly to an upper leg of the diver.

2. A diver propulsion assembly according to claim 1, wherein said means comprises a thruster mounting assembly including an elongated thigh-carried thruster retention frame joined at its proximal end to said waist belt.

3. A diver propulsion assembly according to claim 2, wherein said thruster mounting assembly is hinged to said waist belt at an ergonomic hinge point for enabling ergonomic movement of said thruster relative to said waist belt during operation of said propulsion assembly by the diver.

4. A diver propulsion assembly according to claim 2, wherein said waist belt comprises a hinge strap attached to said thruster mounting assembly, and enabling ergonomic movement of said thruster relative to said waist belt during operation of said propulsion assembly by the diver.

5. A diver propulsion assembly according to claim 4, wherein said thruster mounting assembly further comprises an ergonomic pivot joint intermediate said thruster retention frame and said hinge strap.

6. A diver propulsion assembly according to claim 5, wherein said pivot joint comprises first and second cooperating connectors pivotably attached together, and enabling ergonomic pivoting of said thruster about a pivot axis generally perpendicular to a pivot axis of said hinge strap.

7. A diver propulsion assembly according to claim 2, wherein said thruster mounting assembly further comprises an adjustable leg strap attached to a distal end of said thruster retention frame, and cooperating with said waist belt to secure said thruster to the upper leg of the diver.

8. A diver propulsion assembly according to claim 2, wherein said thruster mounting assembly extends outwardly from said waist belt approximately 12-18 inches.

9. A diver propulsion assembly according to claim 1, wherein said thruster comprises an electric motor and propeller.

10. A diver propulsion assembly according to claim 9, and comprising diver-actuated motor controller adapted for selectively adjusting a drive speed of said propeller.

11. A diver propulsion assembly according to claim 9, and comprising a battery pack operatively connected to said electric motor.

12. A diver propulsion assembly, comprising:

a waist belt adapted for wear by a diver;

first and second spaced apart thigh-mounted thrusters for propelling the diver through a body of water; and first and second thruster mounting assemblies cooperating with said waist belt for mounting respective first and second thrusters directly to upper legs of the diver.

13. A diver propulsion assembly according to claim 12, wherein said first and second thrusters are carried by said waist belt, and spaced apart approximately 18-24 inches along an extended length of said waist belt.

14. A diver propulsion assembly according to claim 12, wherein each thruster mounting assembly comprises an elongated thigh-carried thruster retention frame joined at its proximal end to said waist belt.

15. A diver propulsion assembly according to claim 14, wherein each thruster mounting assembly is hinged to said waist belt at an ergonomic hinge point for ergonomic movement of said thruster relative to said waist belt during operation of said propulsion assembly by the diver.

16. A diver propulsion assembly according to claim 14, wherein said waist belt comprises first and second hinge straps attached to respective thruster mounting assemblies, and enabling ergonomic movement of said thruster relative to said waist belt during operation of said propulsion assembly by the diver.

17. A diver propulsion assembly according to claim 16, wherein each thruster mounting assembly comprises a pivot joint intermediate said thruster and said hinge strap, and said pivot joint comprising first and second cooperating connectors pivotably attached together and enabling ergonomic pivoting of said thruster about a pivot axis generally perpendicular to a pivot axis of said hinge strap.

18. A diver propulsion assembly according to claim 14, wherein each thruster mounting assembly further comprises an adjustable leg strap attached to a distal end of said thruster retention frame, and cooperating with said waist belt to secure said thruster to the upper leg of the diver.

19. A diver propulsion assembly according to claim 14, wherein each of said thruster mounting assemblies extends outwardly from said waist belt approximately 12-18 inches.

* * * * *